US006772465B2

(12) United States Patent
Mehta

(10) Patent No.: US 6,772,465 B2
(45) Date of Patent: Aug. 10, 2004

(54) CLEANSING AND MASSAGING UTENSIL

(76) Inventor: Bhavna Mehta, 656 Lyndale Ct., Paoli, PA (US) 19301

( * ) Notice: Subject to any disclaimer, the term of this patent is extended or adjusted under 35 U.S.C. 154(b) by 524 days.

(21) Appl. No.: 09/819,412

(22) Filed: Mar. 28, 2001

(65) Prior Publication Data

US 2002/0138929 A1 Oct. 3, 2002

(51) Int. Cl.[7] ..... A46B 9/00; A46B 9/02
(52) U.S. Cl. ..... 15/106; 15/227; 601/137
(58) Field of Search ..... 15/106, 110, 118, 15/227; 601/137, 138

(56) References Cited

U.S. PATENT DOCUMENTS

| | | | | | |
|---|---|---|---|---|---|
| 404,588 | A | | 6/1889 | Bailey | |
| 671,047 | A | | 4/1901 | Fox | |
| 687,363 | A | | 11/1901 | Wirt | |
| 718,958 | A | | 1/1903 | Turck | |
| 799,895 | A | | 9/1905 | Doughty et al. | |
| 804,680 | A | | 11/1905 | Smith | |
| 1,018,939 | A | * | 2/1912 | Sterrick | 15/110 |
| 1,062,053 | A | | 5/1913 | Strong | |
| 1,161,719 | A | | 11/1915 | Norton | |
| 1,188,214 | A | * | 6/1916 | Sohn | 222/242 |
| 1,389,957 | A | * | 9/1921 | Martin | 15/160 |
| 1,713,756 | A | | 5/1929 | Hassler | |
| 1,838,958 | A | * | 12/1931 | Page | 15/160 |
| 1,885,572 | A | | 11/1932 | Wood | |
| 2,075,413 | A | | 3/1937 | Welker | |
| 2,379,330 | A | | 6/1945 | Wilensky | |
| 2,431,433 | A | | 11/1947 | Solakian et al. | |
| 2,480,097 | A | | 8/1949 | Holden | |
| 2,516,491 | A | | 7/1950 | Swastek | |
| 2,562,418 | A | | 7/1951 | Enrico et al. | |
| 2,590,977 | A | | 4/1952 | Kay | |
| 2,722,706 | A | | 11/1955 | Chopp | |
| 2,827,895 | A | * | 3/1958 | Clohecy | 601/137 |
| 2,944,273 | A | | 7/1960 | Harris | |
| 3,753,266 | A | * | 8/1973 | Ceniceros | 15/110 |
| 3,867,928 | A | * | 2/1975 | Tupper | 601/137 |
| 4,308,860 | A | | 1/1982 | Sanders et al. | |
| 4,766,914 | A | | 8/1988 | Briggs | |
| 4,893,955 | A | | 1/1990 | Zielinski | |
| 5,048,143 | A | * | 9/1991 | Carroll | 15/110 |
| 5,291,878 | A | * | 3/1994 | Lombardo et al. | 601/139 |
| 5,566,416 | A | * | 10/1996 | Karls | 15/104.04 |
| 5,704,089 | A | * | 1/1998 | Walters | 15/227 |
| 5,765,252 | A | | 6/1998 | Carr | |
| 5,840,048 | A | | 11/1998 | Cheng | |
| 6,134,737 | A | * | 10/2000 | Remme | 15/110 |
| 6,438,784 | B1 | * | 8/2002 | Yu | 15/106 |

* cited by examiner

*Primary Examiner*—Terrence R. Till
(74) *Attorney, Agent, or Firm*—Robert S. Lipton, Esq.; Lipton, Weinberger & Husick

(57) ABSTRACT

A hygienic utensil having improved cleansing members for effectively cleaning and massaging the scalp is provided. The utensil for cleansing and massaging skin includes, a body and a plurality of branched bristle bundles. The plurality of branched bristle bundles extend outward from the body. The branched bristle bundles are grouped together to form cleansing members and attached to pedestals extending from the body. The cleansing members have a centermost portion in which the bristle lengths are shorter relative to the outermost bristle lengths.

9 Claims, 9 Drawing Sheets

CLEANSING AND MASSAGING UTENSIL

The present invention relates, in general, to a utensil for cleansing and massaging a skin surface. More particularly, this invention provides a utensil having improved cleansing members for effectively cleaning and massaging the scalp.

BACKGROUND OF THE INVENTION

A typical daily hygiene regimen includes cleansing the skin and hair with the aid of soaps and/or shampoos. Shampoos for the hair, in particular, are available in a variety of brands and formulations for the purpose of enhancing the appearance/condition of the hair. While some shampoos are specifically designed to treat scalp conditions such as dandruff and psoriasis, routine cleansing and massaging of the scalp is often ignored or attended to in an inconsistent manner.

It is widely accepted that proper scalp cleansing can prevent many of the factors which contribute to and/or aggravate such conditions as dandruff and psoriasis. Moreover, scalp stimulation increases blood flow to the scalp which has been shown to be beneficial in those with thinning and/or unhealthy hair. However, presently, proper scalp cleansing is often overlooked absent a medical condition such as the type mentioned above.

For example, a typical hair cleansing routine consists of a small amount of shampoo being applied by hand to the hair surface where the shampoo may or may not be worked into the hair root area with the fingers. As such, cleansing and/or massaging of the scalp is not uniformly or effectively done, and depending on hair thickness and cleansing habits of some, may not be done at all.

Accordingly, there is a need for a hair utensil to effectively massage and cleanse the scalp for use during routine hygienic activities.

SUMMARY OF THE INVENTION

It is an objective of the invention to provide a utensil having improved cleansing members for effectively cleaning and massaging the scalp. The utensil for cleansing and massaging skin includes, a body and a plurality of branched bristle bundles. The plurality of branched bristle bundles extend outward from a pedestal portion attached to the body. The branched bristle bundles are grouped together to form cleansing members. The cleansing members have a centermost portion in which the bristle lengths are shorter relative to the outermost bristle lengths.

In a further objective of the invention a utensil for cleansing and massaging skin is provided, including, a body and a plurality of body members. An elevated branched pedestal extends outward from each of the body members and each branch of the pedestals has an elevated surface. A plurality of branched bristle bundles extending outward from the body members, the branched bristle bundles being grouped together to form cleansing members, the cleansing members have a centermost portion in which the bristle lengths are shorter relative to the outermost bristle lengths.

In still a further aspect of the invention, at least one ring element is secured to the body. The ring element includes bristles along a surface thereof for cleansing the scalp during use.

It is another objective of the invention to provide a body having a facing surface. The body includes a plurality of recessed depressions therein and a plurality of balls housed in a corresponding one of the recessed depressions. The balls are rotatably suspended within the recessed depressions and each ball has a portion protruding from a corresponding one of the recessed depressions for contacting and rotating about the skin surface.

It is to be understood that both the foregoing general description of the invention and the following detailed description are exemplary, but are not restrictive, of the invention.

BRIEF DESCRIPTION OF THE DRAWING

The invention is best understood from the following detailed description when read in conjunction with the accompanying drawings.

DETAILED DESCRIPTION OF THE INVENTION

Figure 1:
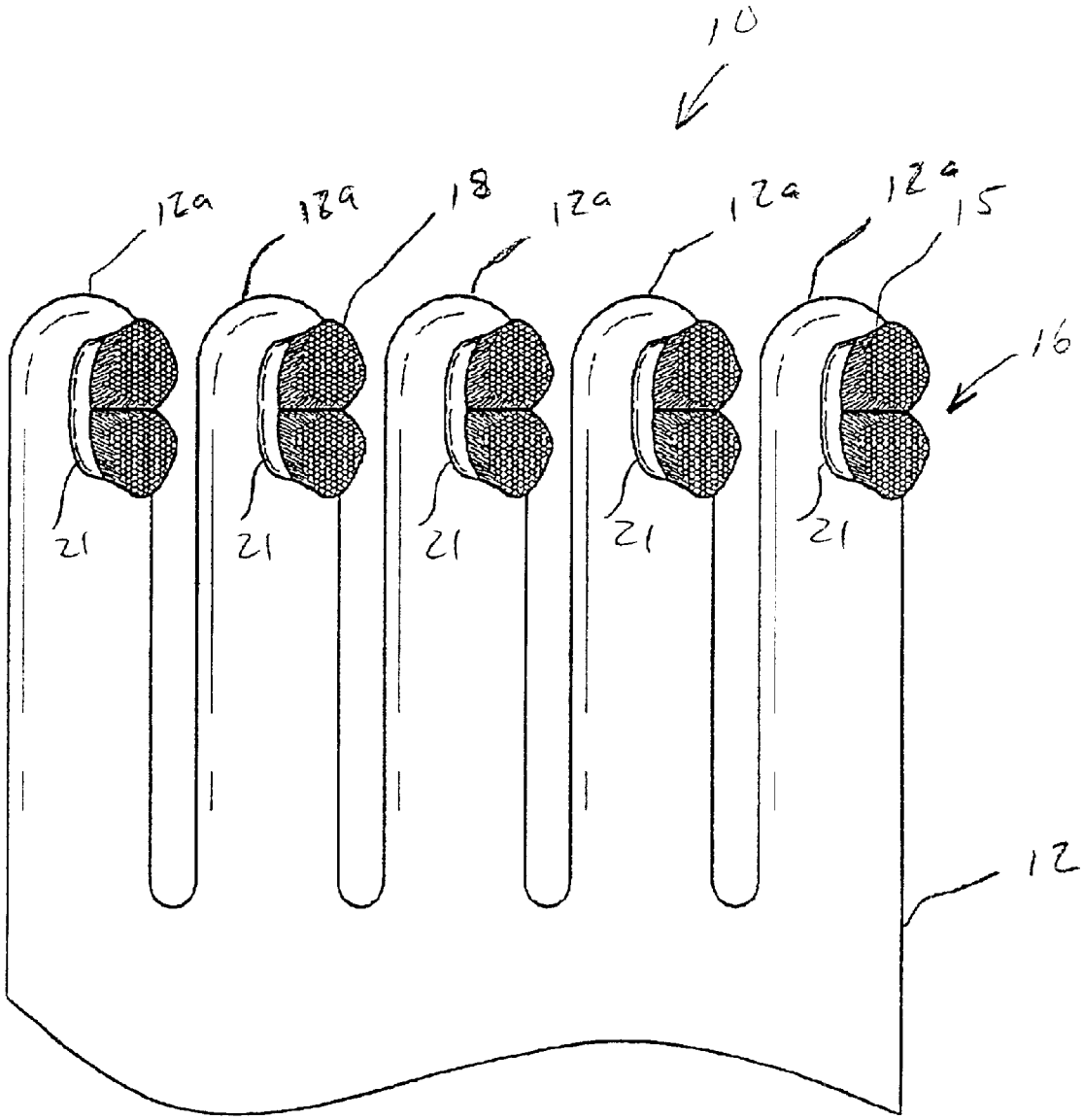
FIG. 1 is a perspective view of a cleansing and massaging utensil in accordance with the present invention.

Certain terminology used in the following description is for convenience only and is not limiting. The words "right," "left," "lower," and "upper" designate directions in the drawings to which reference is made. The words "inwardly" and "outwardly" refer to directions toward and away from, respectively, the geometric center of the hygienic utensil in accordance with the present invention., and designated parts thereof. The terminology includes the words noted above as well as derivatives thereof and words of similar import. The term "cleansing and massaging member" is generally defined as the portions of the utensil contacting the scalp during use.

The hygienic utensil or "brush" described herein employs cleansing and massaging members provided for use as an aid in the daily cleansing of human scalps and/or skin. It is recognized by those skilled in the art that the present invention is not limited to a specific application and can be readily employed on other areas of the body or used for general cleansing purposes.

Referring now to the drawings in detail, wherein like numerals indicate like elements throughout, there is shown in FIGS. 1–22, a hygienic utensil, generally designated 10 in accordance with the present invention. The hygienic utensil 10 is provided for cleansing and massaging an area of skin, preferably the scalp during shampooing. In the preferred embodiment, the body 12 of the utensil 10 is formed of a rigid material such as a thermoplastic or wood and employs a plurality of cleansing and massaging members 15. The body 12 may be contoured to adapt to rounded portions of skin such as the scalp. In an alternative embodiment, the body 12 may be an elastomeric sleeve and/or glove to be worn on the hand of a user such that the user's hand can readily adapt to an irregular surface.

Figure 2:
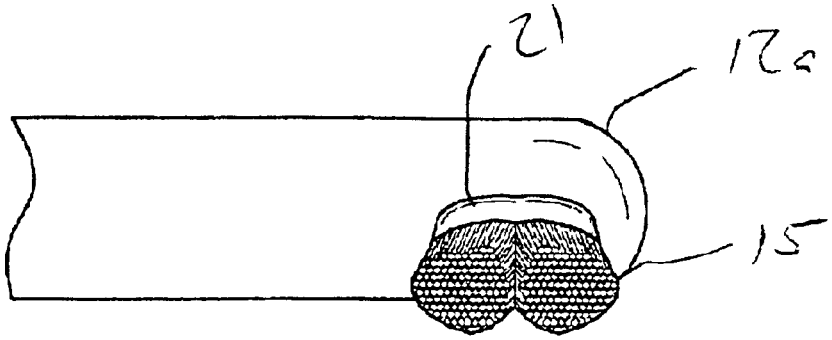
FIG. 2 is a side view of the cleansing and massaging member of the utensil of FIG. 1.
Figure 3:
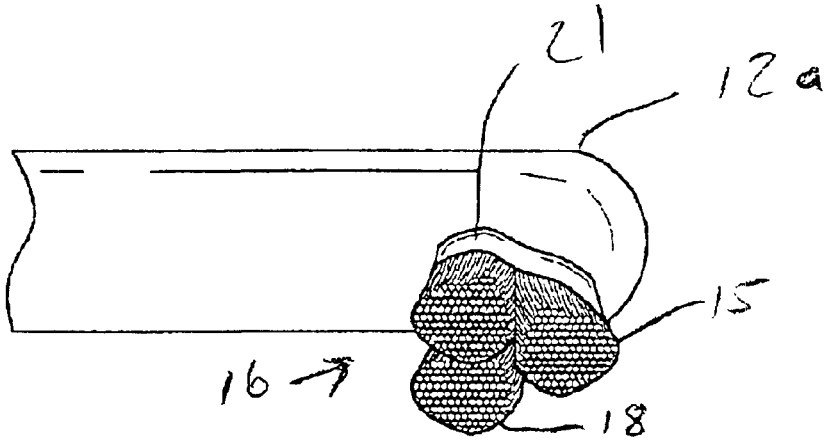
FIG. 3 is a side view of a cleansing and massaging member having three branched bristle bundles.
Figure 4:
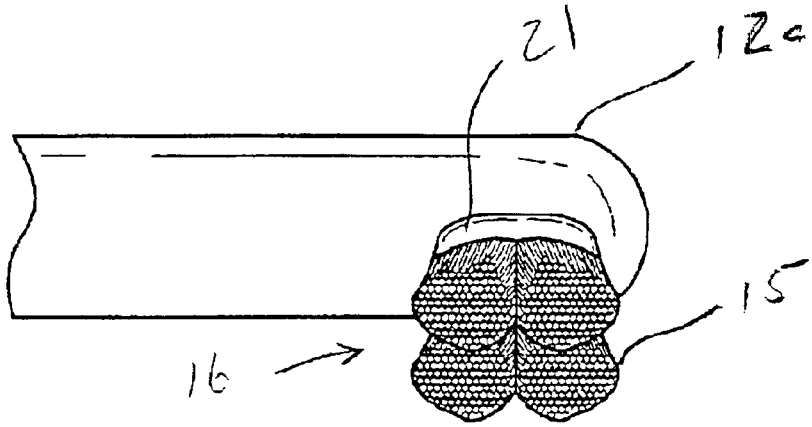
FIG. 4 is a side view of a cleansing and massaging member having four branched bristle bundles.

In an exemplary embodiment shown in FIG. 1, a portion of the utensil 10 (shown cut-away) employs a plurality of cleansing and massaging members 15 fixedly mounted to pedestals 21 which are fixedly mounted to individual body members, generally designated 12*a*. Body members 12*a*, while shown as elongated portions of utensil structure, may be areas of an essentially planar utensil 10. In this embodiment, each cleansing and massaging member 15 is a plurality of bristle bundles 16. Each bristle 18 of each bundle 16 is preferably elongated in shape and constructed of nylon and/or thermoplastic material. In the exemplary embodiment, the bristle bundles 16 are branched for maximizing the footprint of the cleansing and massaging member upon contact to a surface. It is recognized by those skilled in the art that many suitable bristle materials exist for providing different levels of structural rigidity to each bristle 18. For example, in alternative embodiments, any number of bristle bundles 16 can be arranged to form a cleansing and massaging member 15 as shown in FIGS. 2–4.

The branched bristle bundles 15 are mounted upon elevated pedestals 21. In an exemplary embodiment, pedestals 21 are constructed of an elastomeric material such as rubber so as not to irritate the scalp upon contact. While the pedestals 21 are shown in FIGS. 1–4 as having a generally planar facing surface for receiving bristle bundles 16, it is recognized by those skilled in the art that the pedestal facing surface may employ a branched facing surface or a contoured or curved surface, for adjusting the mounting elevation and/or orientation of bristle bundles 16.

As shown in FIGS. 1–4, each cleansing and massaging member 15 is formed of bristle bundles 16. Each bundle 16 of bristles 18 are provided to have differing lengths of bristles 18, preferably the bundles 16 of bristles 18 are arranged so that the centermost portion of the cleansing and massaging members 15 have bristles 18 of a shorter length relative to the outermost bristles 18.

In using the exemplary embodiment of FIGS. 1–4, pressure is placed on the utensil 10 by a user to cleanse the scalp, the bristles 18 are biased outwardly with respect to the center of the bristle bundles 15 to allow the shorter bristles to contact the scalp surface.

Figure 5:
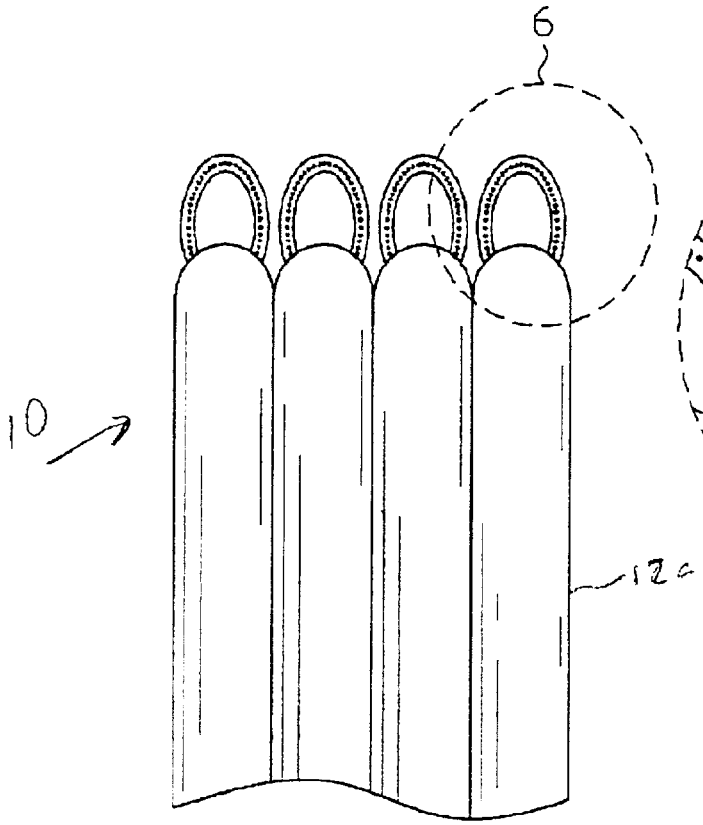
FIG. 5 is a perspective view of an exemplary embodiment of the invention in accordance with the present invention.
Figure 6:
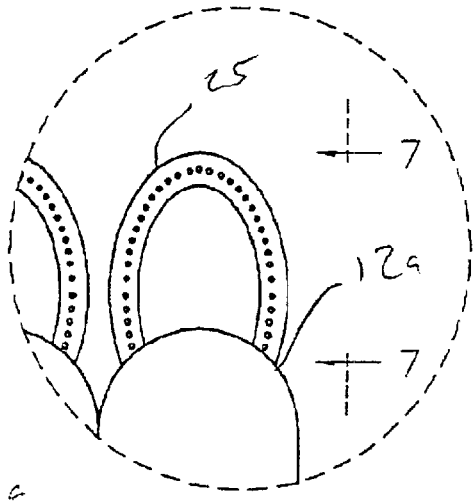
FIG. 6 is an enlarged view of a ring element of the cleansing and massaging utensil of the exemplary embodiment as shown by inset 6 of FIG. 5.

Referring now to FIG. 5, an exemplary embodiment of the utensil 10 is shown employing ring elements 25. Ring elements 25 employ bristles 27 which are shown in FIG. 6 as extending from an annular facing surface of ring element 25. In the exemplary embodiment, ring elements 25 are constructed of an elastomeric material such as rubber, however those skilled in the art recognize that any number of flexible materials may be utilized. Moreover while ring elements 25 are shown as having only a single facing surface employing bristles 27, those skilled in the art recognize that any number of ring element surfaces may employ bristles 27 such as those shown along the side annular surface of FIGS. 8–10.

Figure 7:
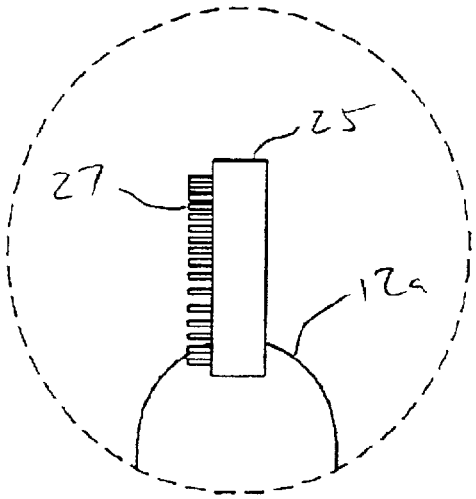
FIG. 7 is side profile taken along lines 7 of FIG. 6.
Figure 8:
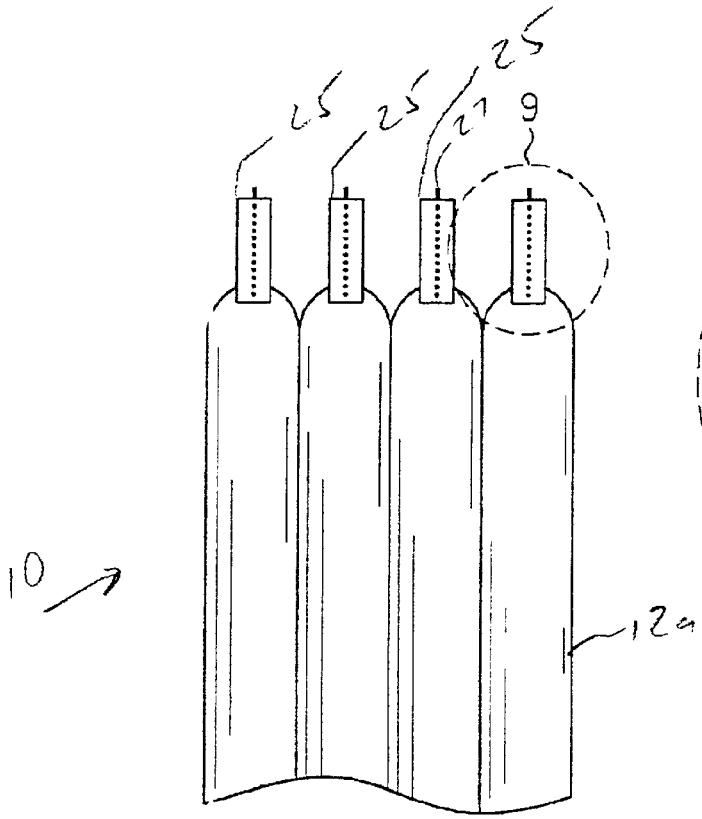
FIG. 8 is a side view of the exemplary embodiment of the invention.
Figure 9:
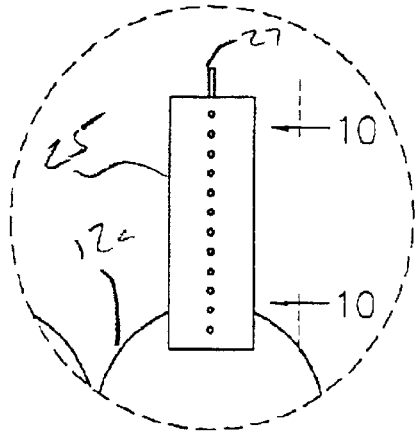
FIG. 9 is an enlarged view of a ring element of the exemplary embodiment of the invention as shown by inset 9 of FIG. 8.

Ring elements 25 of FIGS. 5–7 are secured to the utensil 10 by looping them through apertures created in the utensil (not shown). The ring elements 25 are provided to rotate and scrub the skin such as the scalp in use by freely moving through the utensil aperture.

Figure 10:
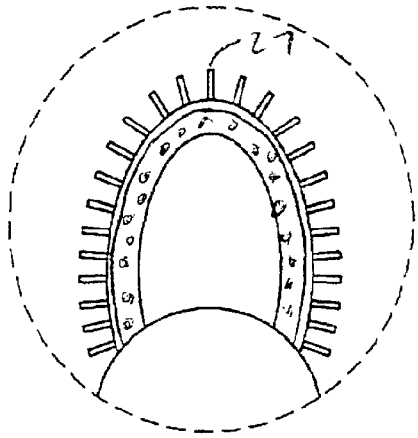
FIG. 10 is a front view of the ring element of the exemplary embodiment of the invention taken along lines 10 of FIG. 9.

As shown in FIG. 10, the ring element may be constructed of an elastomeric annular ring 31 secured to a foam or sponge-like base material 33. The sponge material 33 being utilized for delivering shampoos and/or soaps and for removing moisture from the surface being cleansed.

Figure 11:
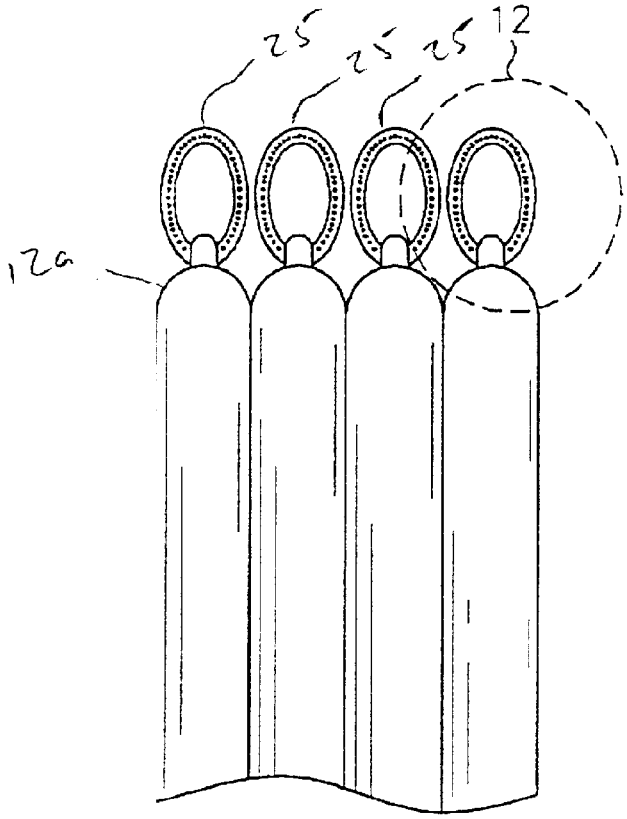
FIG. 11 is a front of an exemplary embodiment of the invention showing ring element anchors.
Figure 12:
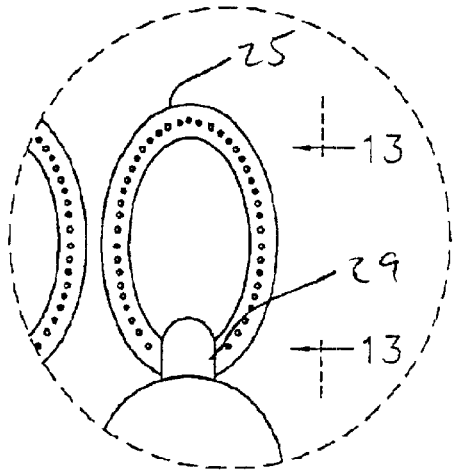
FIG. 12 is an enlarged view of a ring element of the exemplary embodiment of the invention as shown by inset 12 of FIG. 11.
Figure 13:
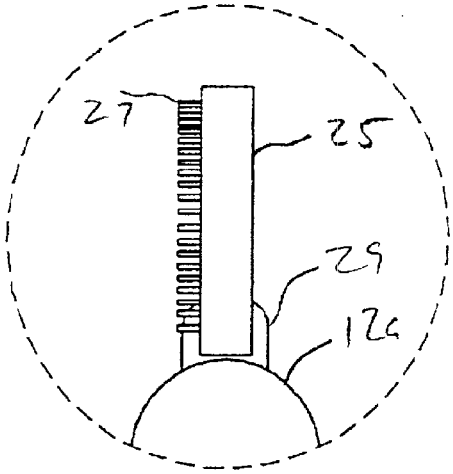
FIG. 13 is side profile of a ring element taken along lines 13 of FIG. 12.

In the exemplary embodiments of FIGS. 11–13 ring elements 25 are secured to utensil 10 by anchor portions 29. The anchor portions 29 provide apertures external to the utensil 10, such that where the utensil 10 is a glove, the rotation of the ring elements 25 is not interfered by a user's hand/and or fingers inside the glove.

Figure 14:
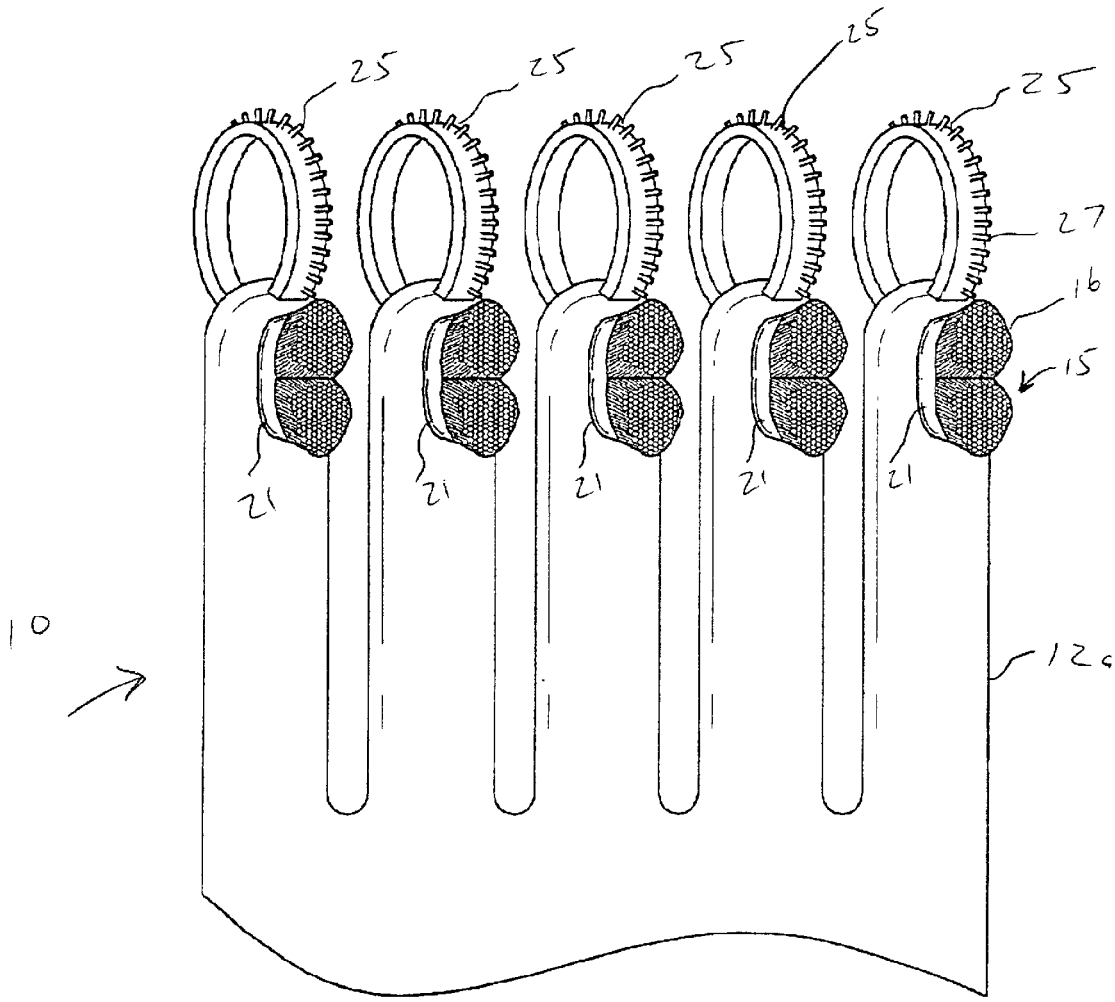
FIG. 14 is a perspective view of an exemplary embodiment of the invention.

In the exemplary embodiment of FIG. 14, both ring elements 25 and cleansing and massaging members 15 are utilized with utensil 10. It is recognized by those skilled in the art that the number, arrangement, and/or orientation of ring elements 25 and cleansing and massaging members 15 is a matter of design choice.

Figure 15:
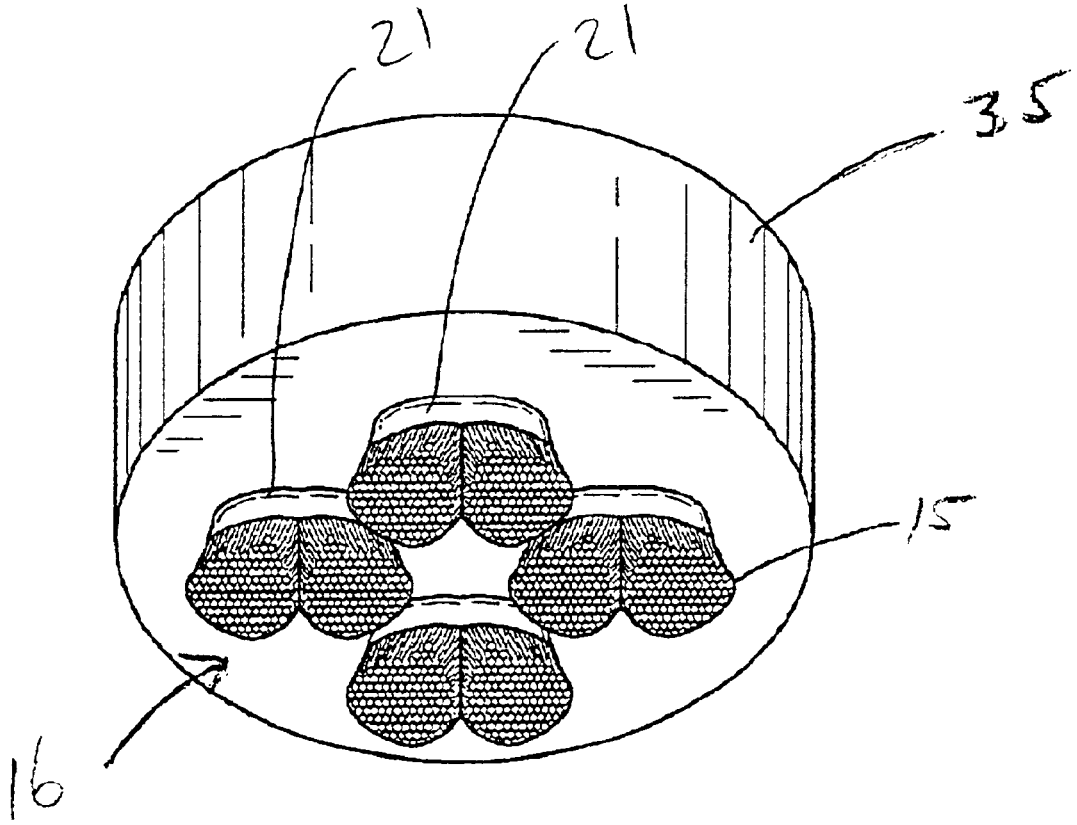
FIG. 15 is a front perspective of a cleansing and massaging element in accordance with an exemplary embodiment of the invention.

FIG. 15 shows a utensil 10 having a body 12 in the shape of an ovoid base, the utensil 10 is designed to be gripped in the palm of the hand for use in intense scrubbing applications, such as the shampooing of an animal.

Figure 16:
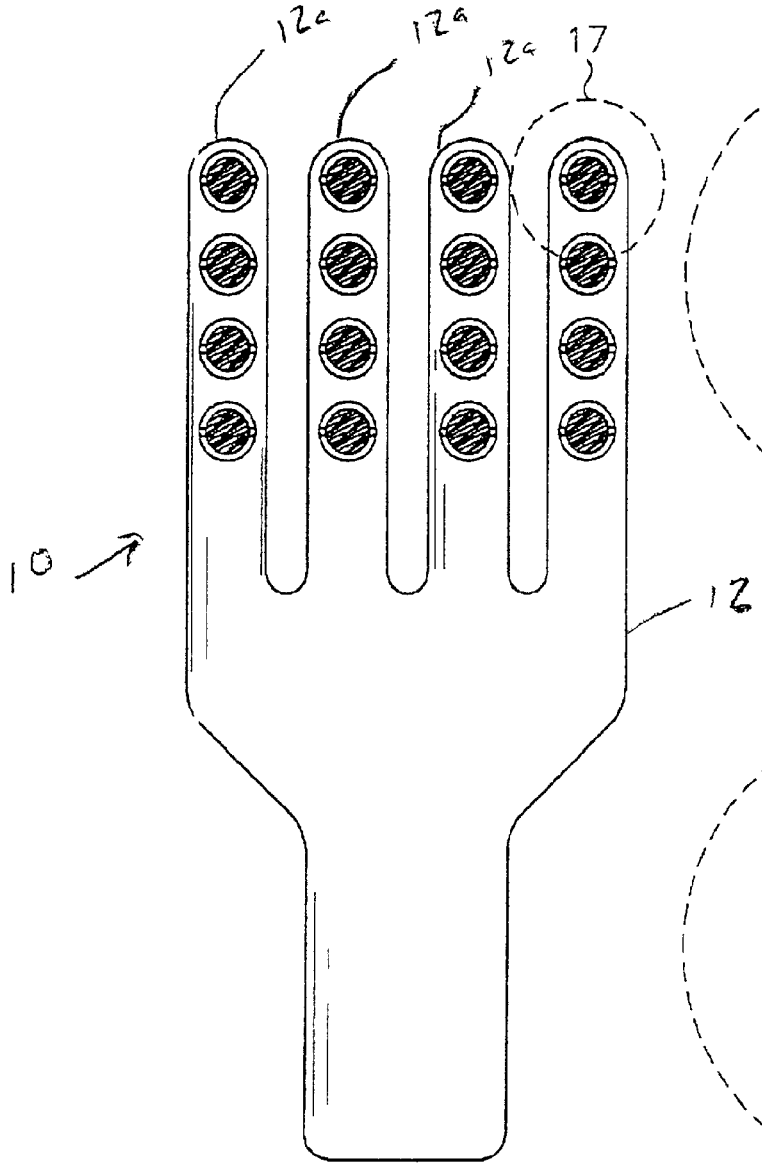
FIG. 16 is a front view of a cleansing and massaging utensil in accordance with an exemplary embodiment of the invention.
Figure 17:
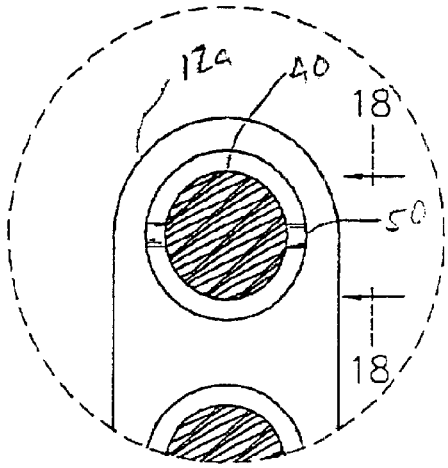
FIG. 17 is an enlarged view of a cleansing and massaging element in accordance with the exemplary embodiment as shown by inset 17 of FIG. 16.
Figure 18:
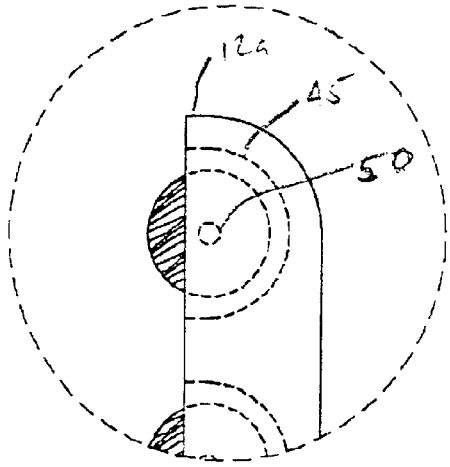
FIG. 18 is a side profile of a cleansing and massaging element in accordance with the exemplary embodiment as taken along line 18 of FIG. 17.
Figure 19:
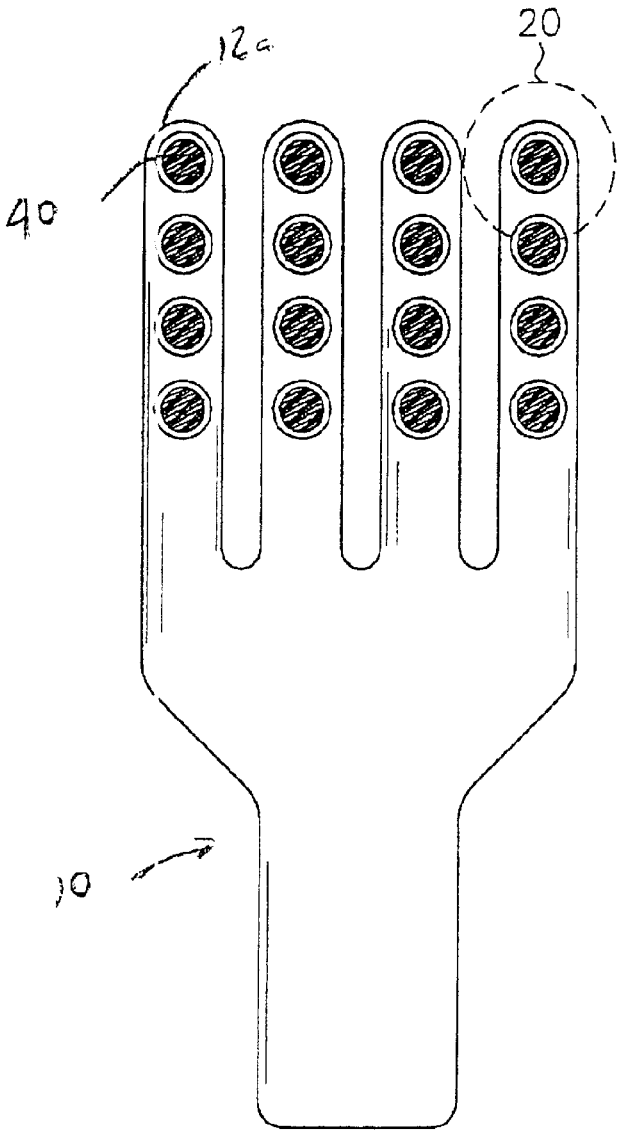
FIG. 19 is a front view of a cleansing and massaging utensil in accordance with an exemplary embodiment of the invention.
Figure 20:
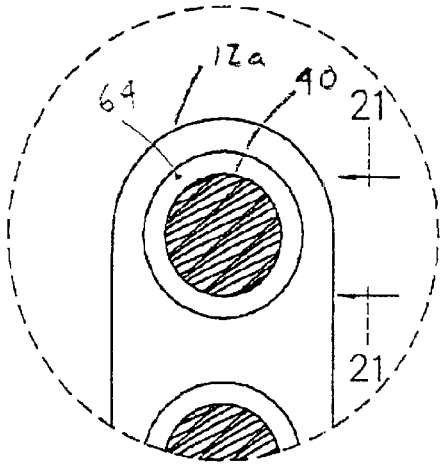
FIG. 20 is an enlarged view of a cleansing and massaging element in accordance with the exemplary embodiment as shown by inset 20 of FIG. 19.
Figure 21:
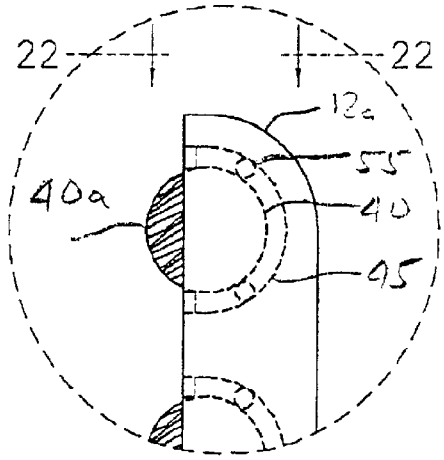
FIG. 21 is a side profile of a cleansing and massaging element in accordance with the exemplary embodiment as taken along line 21 of FIG. 20.
Figure 22:
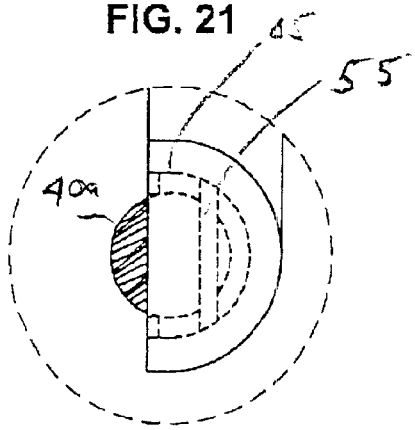
FIG. 22 is a front view of a cleansing and massaging element in accordance with the exemplary embodiment as taken along line 22 of FIG. 21.

In an embodiment shown in FIGS. 16–18, a hygienic utensil, generally designated 10 is shown in accordance with the present invention. The hygienic utensil 10 is provided for cleansing and massaging an area of skin, preferably the scalp during shampooing. In the preferred embodiment, the body 12 of the utensil 10 is formed of a rigid material such as a thermoplastic or wood and employs a plurality of cleansing and massaging members 15. It is recognized by those skilled in the art that a flexible body 12 may be utilized for adapting the shape of the utensil 10 to irregular surfaces.

In this embodiment, the massaging and cleansing members 15 are resilient balls 40. The resilient balls 40 are constructed of an elastomeric material such as rubber. The balls are housed in a corresponding one of a recessed depression 45 in the body 12 (shown as a body member 12*a* in the FIGS.) As shown in FIGS. 17–18, the balls 40 are rotatably suspended within each of the recessed depressions 45 such that a portion 40*a* of the balls 40 protrude from the depressions 45 to contact the skin surface when is use. In the exemplary embodiment, the exterior surface of the balls 40 have an irregular surface for use in cleansing. The recessed depressions are typically about 10% greater in circumference than the circumference of the balls 40 for providing unobstructed rotation. Preferably, the balls protrude from the surface of the body 12 by a distance of ⅜ of an inch.

In an alternative embodiment, shown in FIGS. 19–22, the balls 40 are seated in the depression 45 by a flange plate 64 which frictionally biases the balls 40 against bearings 55 for providing ball rotation in a manner typical to that of a computer mouse.

In use, when pressure is placed on the utensil 10 as it cleanses the scalp, the ball portions 40*a* protruding from the depressions 45 bristles 18 rotatably contact the scalp surface for cleansing and massaging.

Although illustrated and described above with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. A utensil for cleansing and massaging skin, comprising:

a body; and a plurality of bristle bundles extending outward from the body, the bristle bundles being grouped together to form cleansing members, the cleansing members having a centermost portion in which the bristle lengths are shorter relative to the outermost bristle lengths;

a pedestal secured to the body for securing the branched bundles to the body; and at least one ring element secured to the body, the ring element, having bristles along a surface thereof.

2. The utensil of claim 1 wherein, the ring element includes a sponge portion.

3. A hygienic utensil comprising:

a body;

a cleansing and massaging member, said cleansing and massaging member being attached to said body;

a ring element, said ring element being connected to said body, said ring element having an annular facing surface;

a plurality of ring bristles, each of said plurality of ring bristles being rod-shaped and having a ring bristle end, each of said ring bristle ends being attached to said annular facing surface of said ring element, each of said plurality of ring bristles extending radially from said annular facing surface of said ring element.

4. The hygienic utensil of claim 3 wherein said cleansing and massaging member comprises a multiplicity of cleansing and massaging member bristles, each cleansing and massaging member bristle having an end attached to said body, each cleansing and massaging member bristle being elongated and having an elongated dimension, said elongated dimension of each cleansing end massaging member bristle projecting from said body, said elongated dimension of each of said plurality of cleansing and massaging member bristles being generally parallel to at least one of said ring bristles.

5. The hygienic utensil of claim 4 wherein said body comprises a plurality of individual body members, said individual body members being joined one to another, said cleansing and massaging member comprising a plurality of said cleansing and massaging members, each of said plurality of said cleansing and massaging members being attached to one of said individual body members, said ring element comprising a plurality of said ring elements, each of said plurality of ring elements being attached to one of said individual body members.

6. The hygienic utensil of claim 5 wherein each of said plurality of cleaning and massaging members comprises a plurality of bristle bundles, each of said plurality of bristle bundles comprising said multiplicity of said cleansing and massaging member bristles.

7. The hygienic utensil of claim 6 wherein each of said plurality of ring elements defines a circle, each of said circles has a center, each of said plurality of ring elements is located such that a single straight axial line will pass through all of said centers, said straight axial line being generally perpendicular to each of said circles.

8. The hygienic utensil of claim 7 wherein each of said multiplicity of massaging and cleansing member bristles is located generally perpendicular to a plane, said straight axial line defined by said centers of said circles falling within said plane.

9. The hygienic utensil of claim 8, further comprising: a plurality of pedestals, each of said plurality of pedestals being attached to one of said individual body members each of said plurality of cleaning and massaging members being retained by one of said plurality of pedestals.

* * * * *